US005344192A

United States Patent [19]

Phillips

[11] Patent Number: 5,344,192

[45] Date of Patent: Sep. 6, 1994

[54] VISUAL VALIDATION MARK FOR BANK CHECKS AND OTHER SECURITY DOCUMENTS

[76] Inventor: George K. Phillips, 301 Beverly Ave., Paso Robles, Calif. 93446

[21] Appl. No.: 24,675

[22] Filed: Apr. 1, 1993

[51] Int. Cl.[5] ..... B42D 15/00

[52] U.S. Cl. ..... 283/91; 283/57; 283/58

[58] Field of Search ..... 283/91, 57, 58

[56] References Cited

U.S. PATENT DOCUMENTS

| | | | |
|---|---|---|---|
| 4,151,666 | 5/1979 | Raphael et al. | 283/904 X |
| 4,210,346 | 7/1980 | Mowry, Jr. et al. | 283/903 X |
| 4,227,720 | 10/1980 | Mowry, Jr. et al. | 283/58 X |
| 4,310,180 | 1/1982 | Mowry, Jr. et al. | 283/903 X |
| 4,341,404 | 7/1982 | Mowry, Jr. et al. | 283/903 X |
| 4,534,398 | 8/1985 | Crane | 162/103 |
| 4,796,921 | 1/1989 | Neiman | 283/91 |

*Primary Examiner*—Paul A. Bell

*Attorney, Agent, or Firm*—Daniel C. McKown

[57] ABSTRACT

A method for producing a validation mark on security paper includes printing the mark on the paper using an ink that has the same color as the paper but which has more uniform directional reflectance than the sheet of paper. That is, the dried ink is a more uniform diffuse reflector than is the paper. When the mark is illuminated by a light source located on one side of the mark, the mark appears lighter than the paper around it when viewed from the same side as the light source, but the mark appears darker than the paper around it when viewed from the side opposite the light source. An exemplary formulation is given.

6 Claims, 2 Drawing Sheets

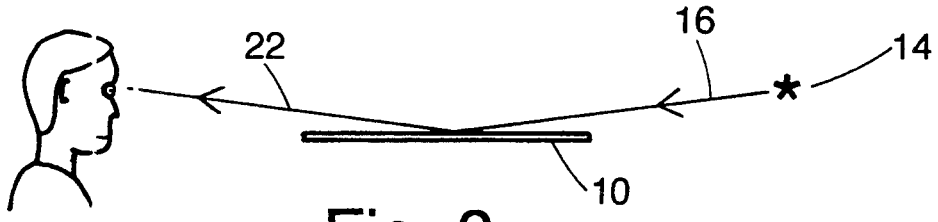
Fig. 3
Fig. 4
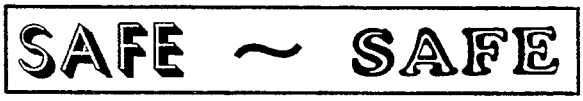
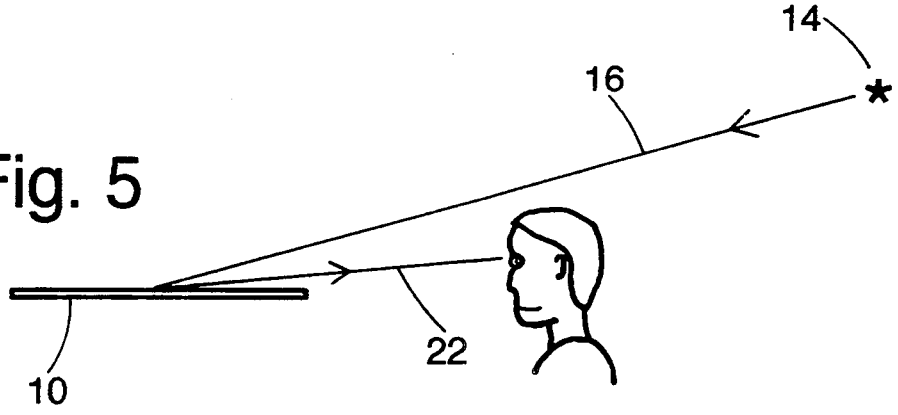
Fig. 5
Fig. 6
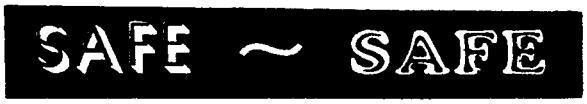

VISUAL VALIDATION MARK FOR BANK CHECKS AND OTHER SECURITY DOCUMENTS

BACKGROUND OF THE INVENTION

1. Field of the Invention

The present invention is in the field of processed security paper and specifically relates to a paper bearing a hidden but visible mark that is not reproducible and which thereby verifies the paper as an original document.

2. The Prior Art

So far as is known, the validation mark of the present invention is unique and can be distinguished from other means for achieving the same result.

Perhaps the earliest validation mark was the watermark, which also does not reproduce, even on the best contemporary copying machines. However, a watermark is usually viewed perpendicular to the paper by light transmitted through the paper, and when viewed in this manner it has the form of a lighter mark on a darker background.

It is also well known to print on a sheet of paper a high resolution background pattern, called a pantograph, that is somewhat difficult to copy and that would normally be destroyed if an attempt is made to alter the original.

In U.S. Pat. No. 4,796,921, Neiman describes the expedient of printing a hidden message onto a sheet of paper using ink that is the same color as the sheet and which is opaque. The message is read by illuminating the back of the sheet, and the message always consists of darker marks on a lighter background.

In U.S. Pat. No. 4,534,398, Crane describes a type of security paper in which optically active devices which have been secured on the surface of a carrier paper are applied to the surface of a base web during dewatering of the base web in the paper manufacturing process. The optically active devices display their optically active properties in reflectance when there are changes in the angle of the incident light with respect to the eye of the viewer.

In U.S. Pat. No. 4,151,666, Raphael, et al. show the use of an optically diffuse reflector integrated with a bond or seal existing between a protective sheet and the information-bearing surface of a laminated document, such as an identification card. The optically diffuse pigment is dispersed in a carrier medium and printed on an adhesive layer that becomes the bond when the identification card is laminated.

A number of other patents are concerned with the unauthorized copying of original documents through the use of modern computer scanners or high quality color copying machines. Typical examples of such patents are the following U.S. patents of Mowry, Jr. et al.: U.S. Pat. Nos. 4,210,346; 4,227,720; 4,265,469; 4,310,180; and 4,341,404. In these patents, typically a cancellation phrase or message is printed in a concealed manner on the face of the protected document so that it cannot be seen on the original document, but the cancellation phrase is produced clearly on any copies made from the original document. It is seen that these techniques are directed against the reproduction of a document; in contrast, the purpose of the present invention is to permit rapid visual validation of an original document.

SUMMARY OF THE INVENTION

In accordance with the present invention, a validation message or mark is printed on a paper using ink whose color closely matches that of the paper and which diffusely reflects incident light substantially uniformly in all directions. The paper on which the ink is applied, because of its inherent glossiness, has a tendency to reflect light preferentially at an angle of reflectance which corresponds to the angle of incidence of the incident light. Accordingly, the brightness of the unprinted portions of the paper depends on the angle at which it is viewed. In contrast, the brightness of the printing is substantially independent of the angle at which it is viewed. As a result, at most viewing angles the validation message will be visible because it will appear either brighter or darker than the unprinted paper background.

The novel features which are believed to be characteristic of the invention, together with further objects and advantages thereof, will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

BRIEF DESCRIPTION OF THE DRAWINGS

FIG. 3 is a diagram showing a first arrangement for viewing the validation mark;

FIG. 4 is a diagram showing the appearance of the validation mark when viewed in the manner shown in FIG. 3;

FIG. 5 is a diagram showing a second arrangement for viewing the validation mark; and, FIG. 6 is a diagram showing the appearance of the validation mark when viewed in the manner shown in FIG. 5.

DETAILED DESCRIPTION OF THE PREFERRED EMBODIMENT

Figure 1:
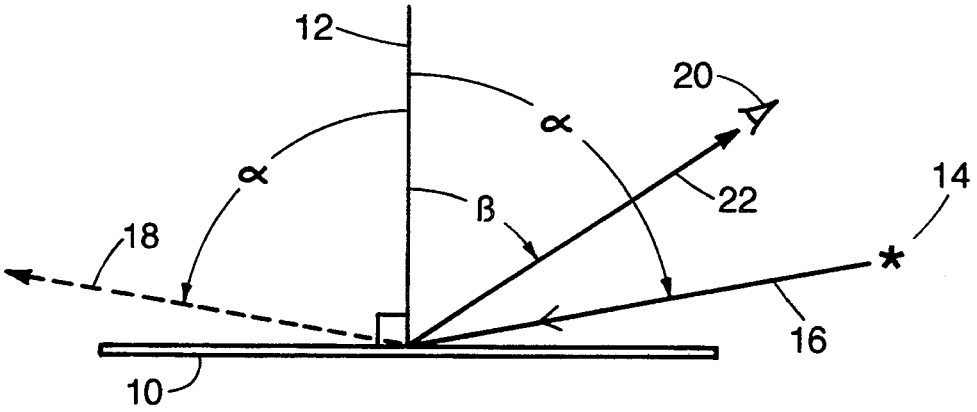
FIG. 1 is a diagram used for defining the angle of incidence and the viewing angle.

FIG. 1 is a diagram showing a sheet 10 of the printed paper of the present invention viewed edgewise. Various angles will be measured from a line perpendicular to the sheet 10, in conformity with conventional optical usage. Light from a source 14 travels along the line 16 to the point where the perpendicular 12 intersects the sheet 10. If that point is unprinted, the light will be reflected in every direction, and typically the reflection will be strongest in the direction indicated by the line 18, to the extent that the sheet 10 is glossy. Most papers exhibit some degree of glossiness caused by calendering during their production. For purposes of explanation, the angle between the perpendicular 12 and the line 16 is denoted by $\alpha$.

FIG. 1 also shows the eye 20 of an observer, and some of the light from the source 14 as it is reflected via the line 22 to the eye 20 of the observer. The angle between the perpendicular 12 and the line 22 is denoted by $\beta$.

Figure 2:
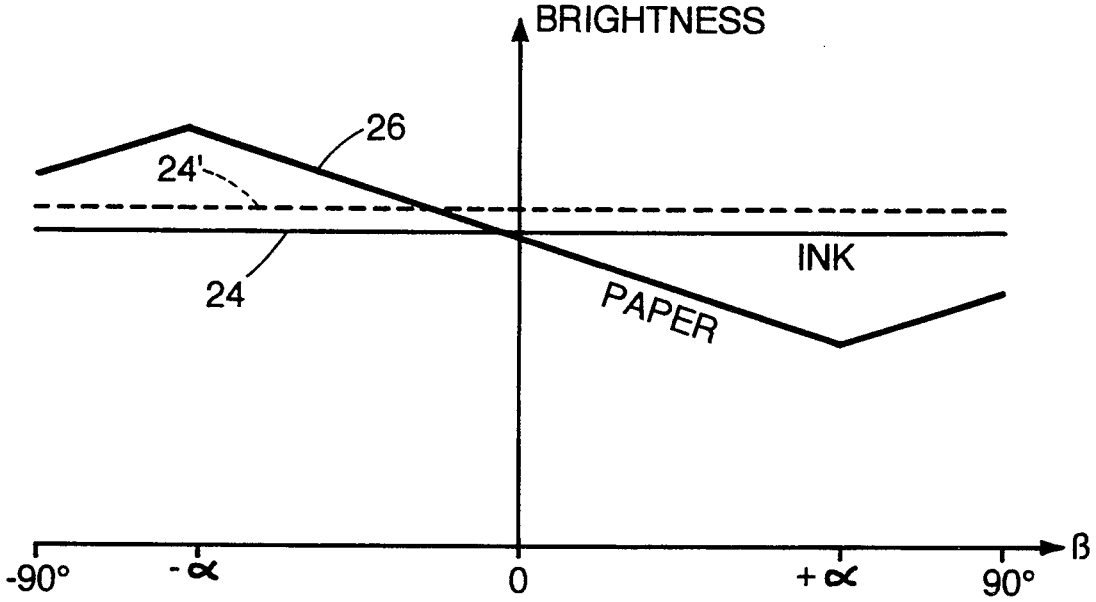
FIG. 2 is a graph showing how the brightness of the paper and of the ink vary with the viewing angle.

FIG. 2 shows two graphs. The first graph is a horizontal line 24 showing the perceived brightness of the ink of the present invention at the point where the perpendicular 12 intersects the sheet 10. The second graph 26 shows the perceived brightness at the point where the perpendicular 12 intersects the sheet 10 assuming there is no ink at that location. That is, the graph 24 shows the brightness of the ink, and the graph 26 shows the brightness of the paper which forms the background on which the ink is printed and viewed. In FIG. 2, the location of the light source 14 is maintained constant, and the position of the eye 20 of the viewer varies.

From FIG. 2 it is seen that the brightness of the ink remains the same regardless of the angle $\beta$ at which it is viewed, but the brightness of the paper depends on the angle at which it is viewed. Ordinarily, the brightness of the paper is least if it is viewed in the direction of the incident light 16, and the brightness is greatest in the direction 18. From FIG. 2 it is seen that when the sheet 10 is viewed at angles $\beta$ close to the angle of incidence a as shown in FIG. 5, the brightness of the ink will exceed the brightness of the paper, and the validation mark will therefore appear as shown in FIG. 6. On the other hand, if the sheet 10 is viewed by grazing light as in FIG. 3, the brightness of the paper will exceed the brightness of the ink, and the validation mark will appear as shown in FIG. 4.

The graphs 24 and 26 of FIG. 2 show an ideal case where the ink and paper have identical brightness when viewed perpendicular to the sheet 10. Although this is the preferred embodiment, in other embodiments the brightness of the ink may differ slightly from the brightness of the paper when viewed perpendicular to the sheet 10. This has the effect of moving the graph 24 slightly up (as indicated by the dashed line 24') or down with respect to the graph 26 in FIG. 2, but that does not change the way in which the validation mark of the present invention works.

In accordance with the preferred embodiment of the present invention, the validation mark is applied to a sheet of paper by printing the mark on the paper using a conventional printing process. The ink is applied in a very thin layer and is not opaque. That is, the validation mark is not visible to the unaided eye when viewed by a light shining through the paper. The ink is unique in its make-up and is closely matched to the color of the paper, and the brightness of the ink after it has been applied to the paper and dried, and when viewed perpendicular to the paper, should be approximately the same as the brightness of the unprinted portion of the paper.

In a preferred embodiment the validating word, such as "VALID" or "SAFE" is printed in what is referred to in the printing arts as an outline font or an open font. Examples of such fonts include: Augustea Inline, Beton Open, Cheltenham Bold Outline, Cheltenham Open, Columna, Franklin Gothic Condensed Outline, Gothic Outline Title No. 61, Stymie Open, Thorne Shaded, and Trump Gravur.

It has been found that the validation mark of the present invention can be applied to previously printed paper and can also be printed upon. This permits the validation mark to be used in combination with other security measures, such as the use of a pantograph and/or a copy-defeating pattern, without impairing the effectiveness of the other measures.

The ingredients of the ink used in the preferred embodiment for use on a white paper, specifically NCR 26 lb. coated back paper, are listed in Table 1. As with most inks, this one includes a pigment, an anti-skin ingredient, a wetting agent, a tack reducer, and varnish. The ink is absorbed into the paper substrate by use of the modified varnish, oils and solvents. The inherent reflectivity of the paper is replaced by that of the ink, thereby producing the desired effect.

TABLE 1

| PERCENT BY WEIGHT | INGREDIENT | |
|---|---|---|
| 57% | WHITE PIGMENT | TITANIUM DIOXIDE-PIGMENT #6 |
| 13% | DULL POWDER | SILICON DIOXIDE |
| 2% | ANTI-SKIN | N-HEXYL CARBITOL |
| 3% | WETTING AGENT | HYPOTHIOLATE CONC. |
| 5% | TACK REDUCER | MAGIE 52 OIL |
| 12% | VARNISH | MODIFIED PHENOLIC RESIN/CUT WITH LINSEED OIL |
| 8% | VARNISH | MODIFIED HYDRO-CARBON RESIN/CUT WITH ALKYD |

The foregoing detailed description is illustrative of one embodiment of the invention, and it is to be understood that additional embodiments thereof will be obvious to those skilled in the art. The embodiments described herein together with those additional embodiments are considered to be within the scope of the invention.

What is claimed is:

1. A validation mark on a sheet of paper, said validation mark comprising:

a coating covering a portion of the sheet of paper, said coating so thin as not to be visible to an unaided eye when viewed by a light shining through the sheet of paper, said coating having substantially the same color as the paper, and having more uniform directional reflective properties than the sheet of paper, whereby when the mark is illuminated by a light source located to one side of the mark, the mark appears lighter than the paper around it when viewed from the same side as the light source and the mark appears darker than the paper around it when viewed from the side opposite the light source.

2. The validation mark of claim 1 wherein said coating is non-opaque and has approximately the same brightness as the sheet of paper when viewed perpendicular to the paper.

3. The validation mark of claim 1 wherein the sheet of paper bears visible indicia.

4. A method for producing a validation mark on paper, said method comprising the step of:

printing the validation mark on the paper with an ink having substantially the same color as the paper, the ink when dry having directional reflective properties that are more uniform than those of the paper, the ink being applied to the paper in a very thin layer that when dry is not visible to an unaided eye when viewed by a light shining through the paper.

5. The method of claim 4 comprising the preliminary step of printing visible indicia on the paper using conventional ink.

6. The method of claim 4 comprising the subsequent step of printing visible indicia on the paper using conventional ink.

* * * * *